United States Patent [19]

Trezise et al.

[11] Patent Number: 4,469,459

[45] Date of Patent: Sep. 4, 1984

[54] COLOR PRINTER

[75] Inventors: Richard Trezise, San Jose; John Boldt, San Ramon; Keith Gnutzman, Alameda, all of Calif.

[73] Assignee: Envision Technology, Inc., San Jose, Calif.

[21] Appl. No.: 370,200

[22] Filed: Apr. 21, 1982

[51] Int. Cl.[3] ..... B41J 35/14; B41J 33/04

[52] U.S. Cl. ..... 400/216.1; 400/59; 400/208; 400/212

[58] Field of Search ..... 400/56, 57, 59, 194, 400/196.1, 208, 212, 216.1, 240.4, 223

[56] References Cited

U.S. PATENT DOCUMENTS

| | | | |
|---|---|---|---|
| 3,855,448 | 12/1974 | Hanagata et al. | 400/120 X |
| 4,033,446 | 7/1977 | Taubert | 400/212 |
| 4,088,218 | 5/1978 | Depew | 400/212 X |
| 4,277,189 | 7/1981 | Howard et al. | 400/328 X |
| 4,280,767 | 7/1981 | Heath | 400/216.3 X |
| 4,391,540 | 7/1983 | Dougherty | 400/216.1 X |

OTHER PUBLICATIONS

*IBM Tech. Disc. Bulletin*, by J. H. Meier, vol. 21, No. 11, Apr. 1979, pp. 4448–4451, 400–124.

*Primary Examiner*—Paul T. Sewell

*Attorney, Agent, or Firm*—Flehr, Hohbach, Test, Albritton & Herbert

[57] ABSTRACT

A color impact matrix printer has replaceable color cartridges which are selectively brought into cooperative engagement with a print head. The printer includes a powered manifold for adjusting the print gap, a cartridge housing which is rapidly moveable by a lever system and a ribbon drive mechanism which allows for selective and incremental driving of each cartridge.

6 Claims, 8 Drawing Figures

COLOR PRINTER

This invention relates generally to a color printer and more particularly to a color matrix printer having replaceable color cartridges which are selectively brought into cooperative engagement with a print head.

In one type of color printer, color print is accomplished by using a single cartridge having a color ribbon containing a plurality of color bands. By shifting position of the ribbon, a color print can be generated. There are several disadvantages to this approach. As is well known, the most frequently used color is black. Thus, when the black band is used up, one must replace the complete ribbon cartridge although all of the other color bands are still usable. This is wasteful and costly. The second disadvantage is the lack of flexibility in obtaining desired color and/or medium combinations. Standard multi-color ribbons come in two versions: primary (black, blue, red, green) and blendable (black, cyan-red, magenta-blue, yellow). Each version is deliberately designed to be either blendable or non-blendable.

A system utilizing a single multi-color ribbon, therefore, cannot offer a simultaneous mixture of blendable and non-blendable inks. Specialized application inks can also be more readily accommodated in a design that does not mandate a common carrier-ribbon.

Another type of color printer uses separate color cartridges. However, in this design, the printer employs a print head for each of the ribbon cartridges or cassettes. This makes the printer unusually large, cumbersome and costly. In addition, there is no provision for individually or incrementally driving each cartridge. Instead, all are driven simultaneously and continuously. This approach mandates for any economical application continuous loop fabric ribbon. The polyester film ribbon, normally associated with better quality impression, cannot be driven continuously with disregard of printer requirements since the cartridge must be replaced when all the film has been withdrawn from its "one time thru" supply reel.

It is an object of the present invention to provide an improved color printer.

It is a further object of the invention to provide a matrix color printer having a print carriage which replaceably and interchangeably accommodates a plurality of ribbon cassettes or cartridges which are selectively brought into cooperative relationship with a print head.

It is a further object of the present invention to provide a color matrix printer having a print carriage which replaceably and interchangeably accommodates a plurality of ribbon cartridges which selectively cooperate with a single print head and in which the selected cartridge ribbon drives are individually, selectively and incrementally driven.

The foregoing and other objects of the invention are achieved in a color matrix printer in which a carriage positions a print head for cooperation with a print medium and the carriage accommodates one or more cartridges which carry ribbon such as cloth or film ribbon and position the ribbon of a selected cartridge for cooperation with the print head whereby to enable printing of a selected color from a selected cartridge in a selected order.

The foregoing and other objects of the invention will be more clearly understood from the following description taken in connection with the accompanying drawings of which:

Figure 1:
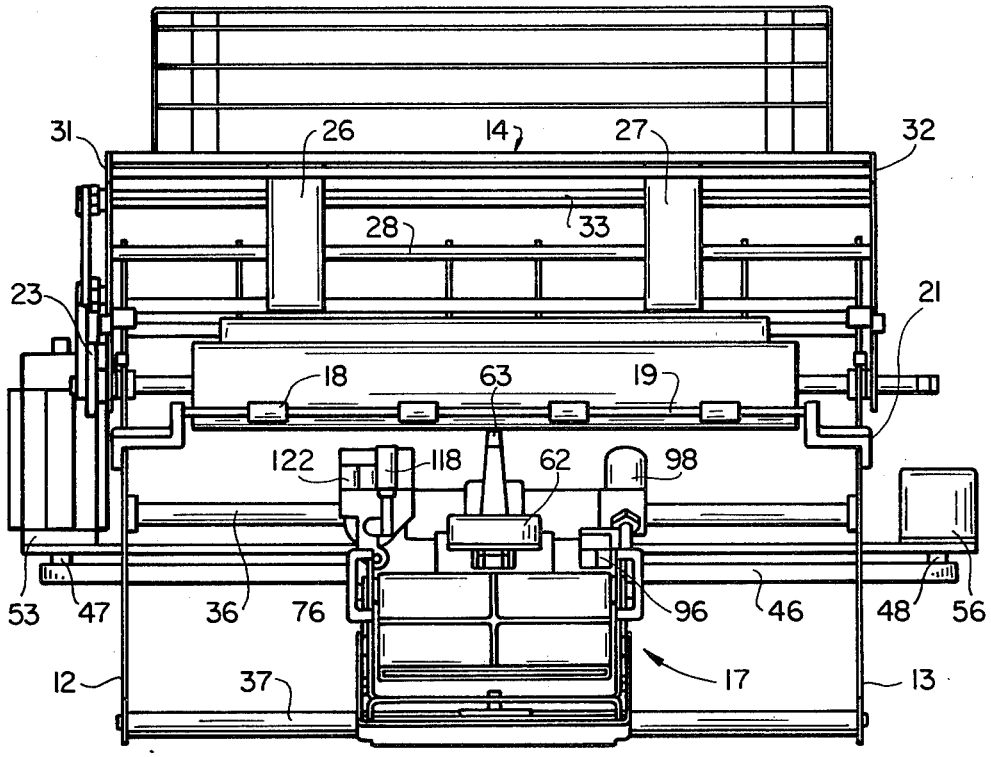
FIG. 1 is a top plan view of a printer in accordance with the present invention.
Figure 2:
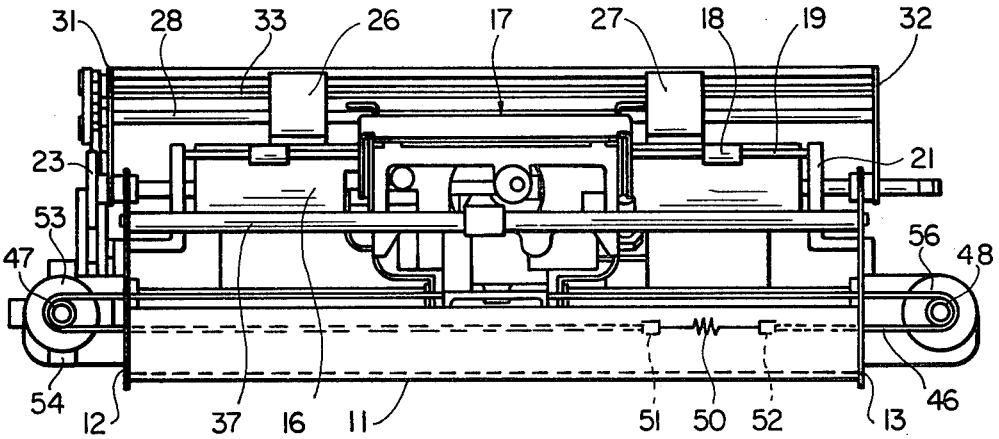
FIG. 2 is a front elevational view of the printer shown in FIG. 1.

Referring first to FIGS. 1 and 2, the printer includes a housing having a base 11 and sides 12 and 13 which house and support the printer components. The rear of the printer includes a housing portion 14 for accommodating the associated electronic control circuits which are carried on printed circuit cards.

The printer utilizes a cylindrical friction feed platen 16 to accurately, bi-directionally feed paper and position it adjacent the print carriage 17. Platen 16 could alternatively be flat if a tractor drive is used. Hold down rollers 18 are rotatably mounted on a shaft 19 which is supported by adjustable levers 21.

The levers may be driven to lift the rollers away from the platen for insertion of paper and lowered to accommodate and hold the paper. The platen 16 may cooperate with a feed roll (not shown) whereby to frictionally drive the paper through the printer. The platen is suitably driven by a gear 23 which is powered by a motor (not shown) mounted in the lower part of the housing.

Optionally the paper may be fed by unidirectional or bi-directional tractors which engage the side perforation of fan-fold paper. A pair of spaced tractors 26 and 27 are adjustably mounted on spaced rails 28 and 33 supported from side members 31 and 32. The tractors are driven by the rail 33 rotatably mounted on the side member 31 and 32, and driven via a drive belt which can be selectively driven from the platen drive motor.

Figure 4:
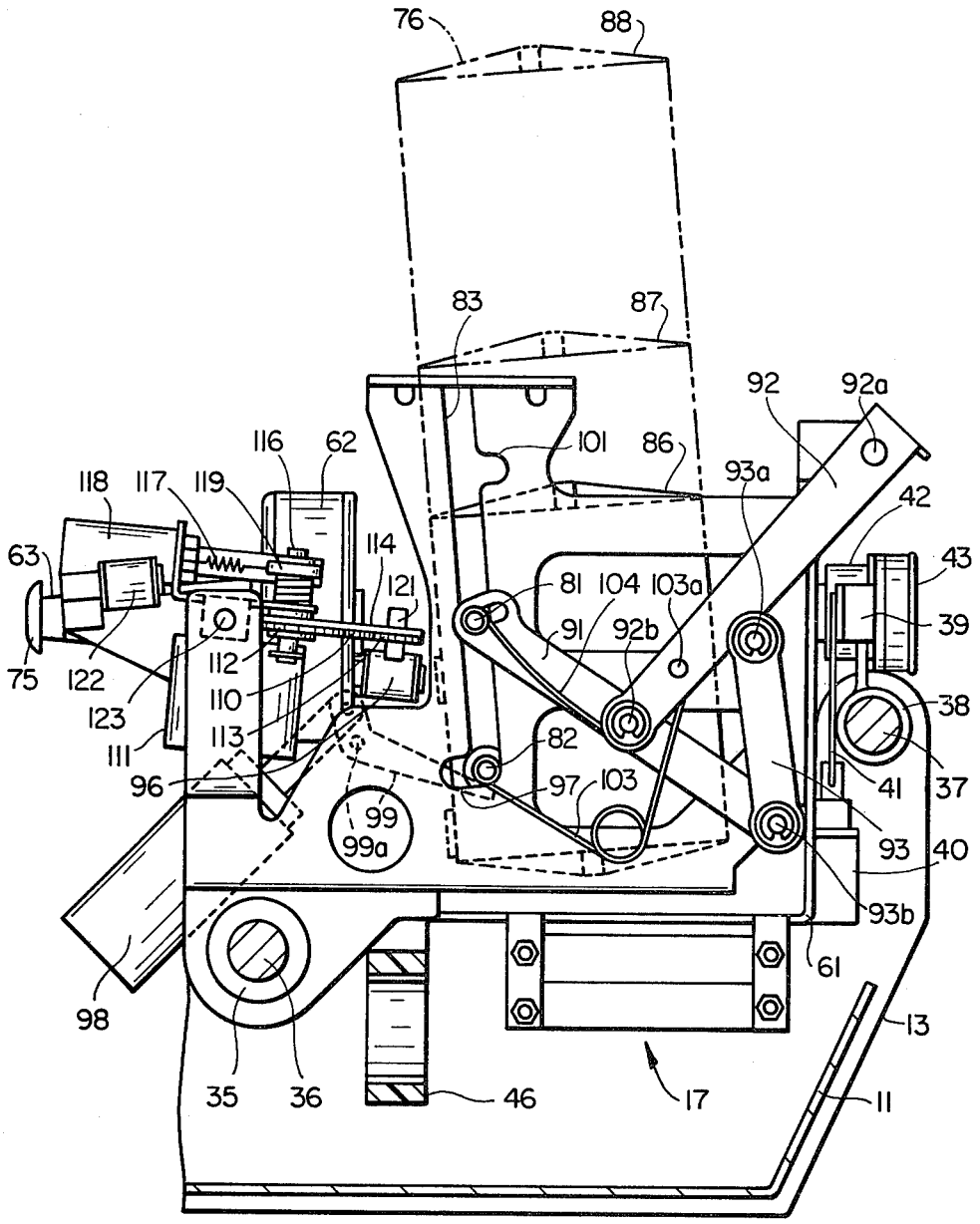
FIG. 4 is an enlarged side elevational view of the print carriage of FIG. 3.

The sidewalls 12 and 13 support spaced carriage rails 36 and 37 which support the carriage assembly 17 in cooperative relationship with the platen 16. As best shown in FIG. 4, the shaft 36 is engaged by a linear bearing 35 while the shaft 37 is engaged by a linear bearing 38.

Referring again to FIGS. 1 and 2, a drive belt 46 is reeled over pulleys 47 and 48 and is secured to the carriage 17. Belt 46 is of a timing belt construction. Thus, to properly tension it, a spring 50 is tied to ends 51 and 52 to load it initially and then associated screws tie the ends to a connecting link. The pulley 47 is driven by motor 53 supported by motor mount 54 whereby the motor serves to position the carriage laterally along the spaced rails 36 and 37. The pulley 48 is associated with a separate encoder 56 which provides output signals indicative of the position of the carriage. The signals are used in an electronic control circuit for positioning the carriage during printing.

Although a conventional carriage positioning system can be utilized to permit printing after the carriage has achieved a constant speed, the carriage is preferably controlled by a control system of the type described in copending application Serial No. 370,331, filed Apr. 21, 1982, entitled SERVO CONTROL SYSTEM, in the names of Edward Goldberg and Larry Herzberg, which permits printing while the carriage is being accelerated and decelerated. Generally the system takes the carriage position signals from the encoder, keeps track of the time lapse between signals, calculates the speed of the carriage and sends control signals to the drive motor 53 to accelerate or decelerate the carriage and simultaneously to drive the print head. Since the software knows at all times the carriage position by knowing its speed and home position, printing can begin during acceleration and deceleration.

Figure 3:
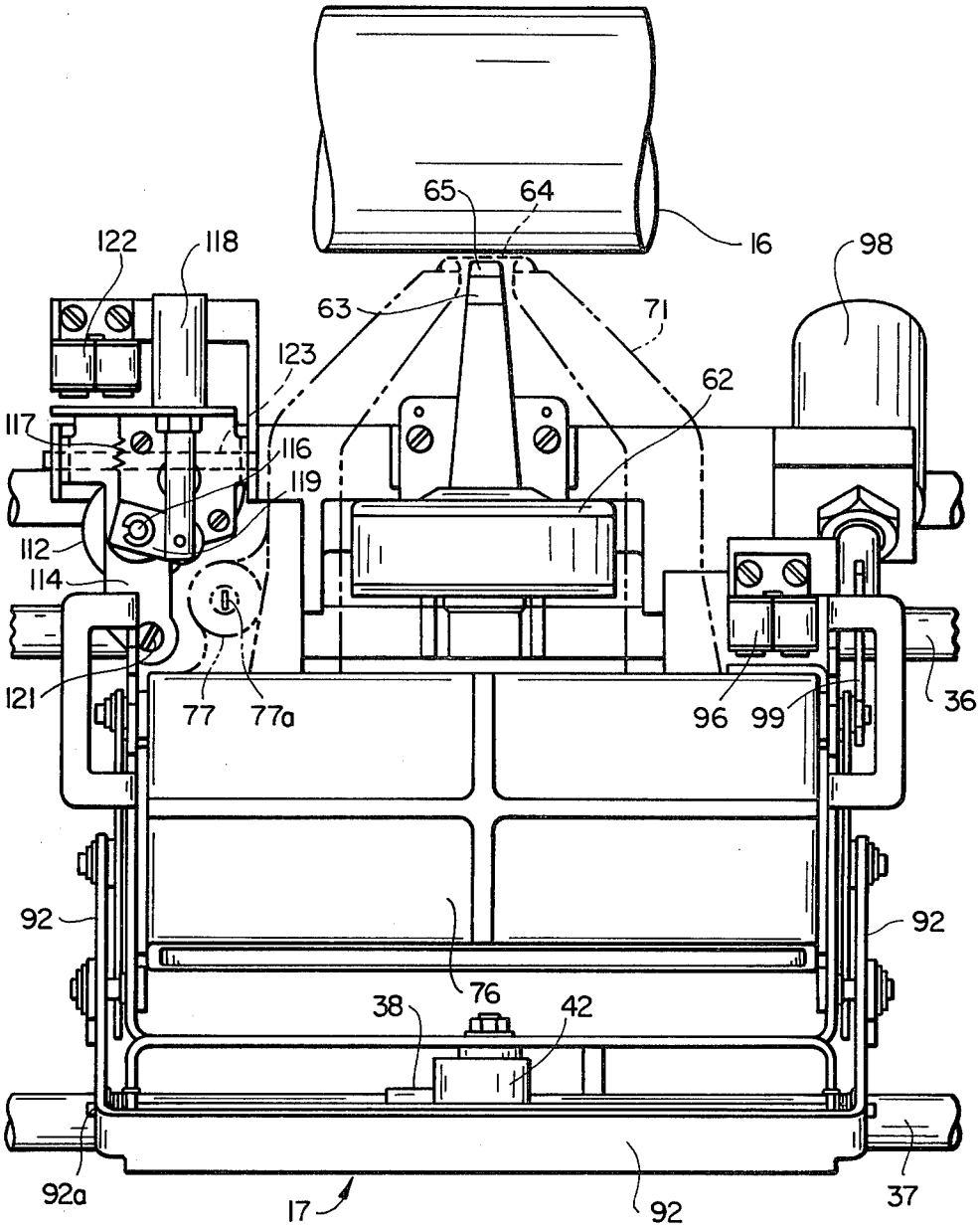
FIG. 3 is an enlarged top plan view of the print carriage.

Referring to FIGS. 3 and 4, as discussed above, the carriage's main frame 61 is supported by the bearings 35 and 38 which ride on rails 36 and 37 respectively. A print head 62 is suitably mounted on the main frame. The print head may be any suitable high speed matrix print head with the end 63 having print wires preferably in two offset rows whereby to increase the print density and which are propelled outwardly to engage the print ribbon 64 and print on paper carried by the platen 16. High speed impact matrix print heads are commercially available from many sources and are not described herein in any additional detail other than to state that the print wires are selectively moved to form letters, characters and graphics under control of a printing program.

Turning to FIG. 3, the print head end 63 includes a ribbon guide 65 which cooperates with the print ribbon 64 adjacent the platen 16. Since the print wires travel only a short distance, the spacing between the print head end 63 and the platen 16 must be carefully controlled. This spacing is known as the print gap. Such control should include vernier adjustments for accommodating various thicknesses of paper and/or ribbon and to facilitate a small print gap so that high frequency printing can be accomplished. At the same time, the adjustment of the print gap, especially in the case of multiple ribbon cartridges, must temporarily provide a larger print gap to allow for a shifting of the ribbon cartridge to, for example, another color or, for that matter, for paper to be moved. Both of these periods can be termed non-printing periods of time. Obviously, if the ribbon is too close during this type of motion, smudges could occur on the paper.

In general, to accomplish the foregoing, the entire main carriage frame as illustrated in FIG. 4 is rotated or tilted about the shaft or rail 36 to thereby bring the head closer or further away from the platen. Since the carriage also rides on the rail 37, the adjustment mechanism has a portion effectively fixed to the rail 37 and thus tilts the carriage in a counterclockwise direction when the ribbon and print head are to be moved closer to the platen and vice versa.

Figure 7:
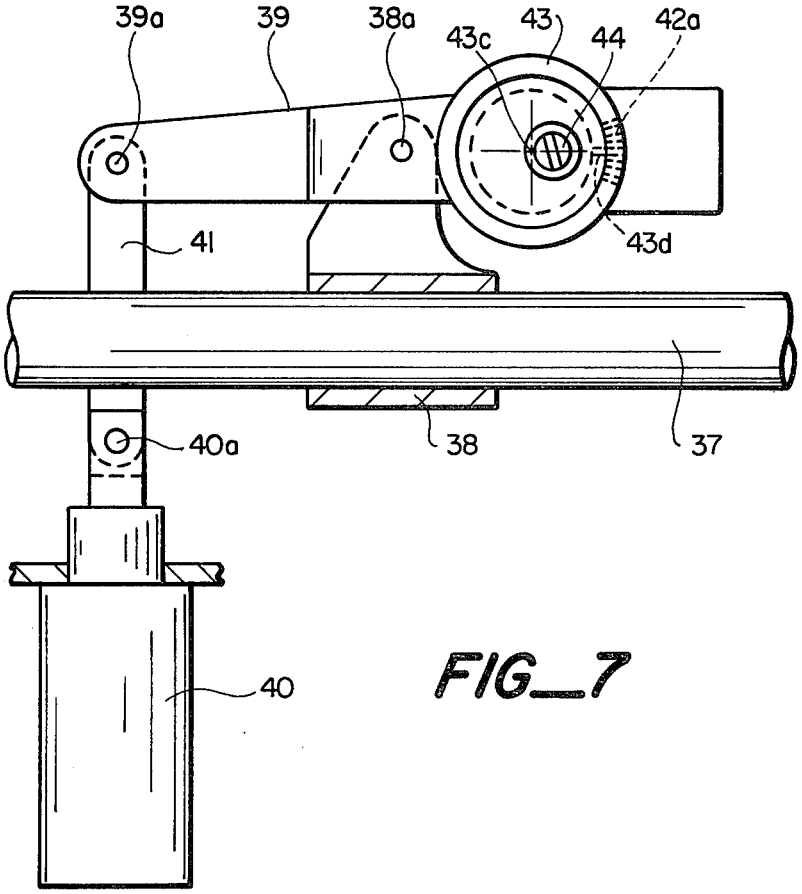
FIG. 7 is an enlarged front elevational view of a detail of the printer.
Figure 8:
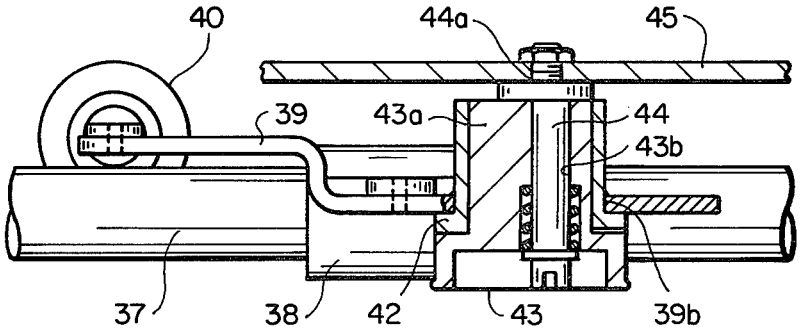
FIG. 8 is a partial and cross-sectional top view FIG. 7.

Details of the adjustment mechanism are illustrated in FIG. 7 and the side cross-sectional view of FIG. 8. In FIG. 7, there is shown the rear rail 37 on which slides the linear rail bearing 38. The upper end of bearing 38 includes a pivot point **38*a* on which is pivoted a pivot arm 39. Arm 39 is moved from the position shown in a clockwise direction by the release or deenergization of a solenoid 40 which is connected to a pivot point 39*a* on pivot arm 39 by a link 41. The other end is pivoted at the solenoid plunger at pivot point 40*a*. As illustrated, the solenoid 40** is in its actuated position which means the carriage is in a normal printing position. Thus, the carriage is tilted counterclockwise to its closest position to the platen so that the print gap is at a minimum. On the other hand, release of this solenoid or deenergization of it will cause the pivot arm to rotate in a clockwise direction as shown by the arrow to widen the print gap.

Still referring to the pivot arm 39, the right hand end of the pivot arm includes a relatively large cutout **39*b* in which is placed a thin walled cylindrical insert 42 (see FIG. 8). The insert 42 and pivot arm 39 form a pivot arm assembly. Insert 42 on its face has a sector of grooves 42*a*. Cylindrical insert 42 acts as a journal bearing cylindrical portion 43*a* of adjustment knob 43. Under its flanged end, it includes a tooth 43*d* which selectively engages one of grooves 42*a*. In portion 43*a*, is a hole 43*b* offset from its axis 43*c*. Through this hole 43*b*, extends a pin 44 which is affixed at its other end 44*a* through a frame portion 45 of the carriage. End 44*a*** has an eccentric mechanism to allow for factory adjustment of the print gap.

In the vernier adjustment mode, which accommodates varying thicknesses of paper, for example, knob 43 is pulled out against the resistance of an interior spring and rotated between one of its detents. In view of the offset location of the pin 44 from the center of rotation of the knob, **43*c*, (which is also the center of the aperture 39*b*), the tilt of the carriage relative the rail 37** is changed and thus the print gap.

In the powered manifold mode, where a wider gap is necessary, for example, because of a change of one cartridge to another, solenoid 40 is de-energized to rotate pivot arm 39 clockwise, thus moving axis **43*c* closer to rail 37** to provide a wider or larger print gap.

Thus, the foregoing adjustment by use of the solenoid operated mechanism provides for a rapid movement of the carriage to provide clearance for rapid shifting of the carriage itself or a change of cartridges. And, on the other hand, a permanent vernier adjustment is available for varying thicknesses of paper.

As described above, the carriage of the present invention permits the use of a plurality of ribbon or film cartridges which are removably mounted in the carriage.

Figure 5:
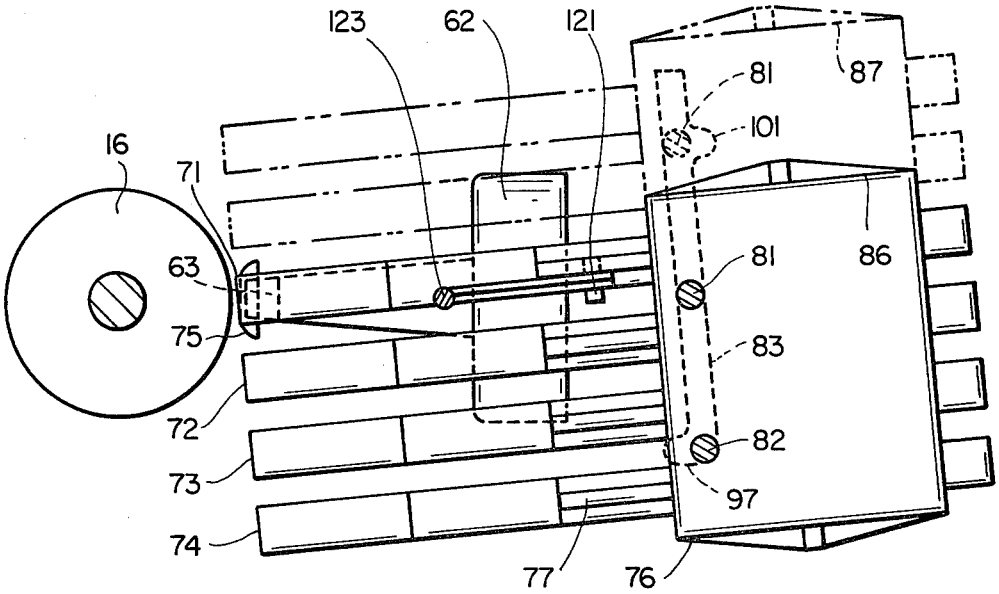
FIGS. 5 and 6 are schematic views illustrating the cooperation of the ribbon cartridges with the print head.
Figure 6:
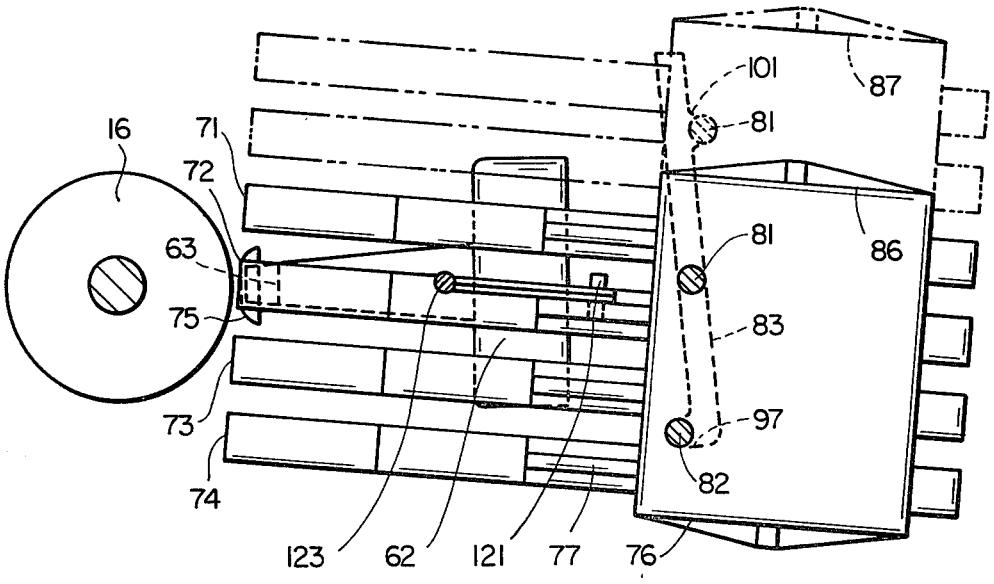

Referring to FIGS. 3, 5 and 6, there are shown four ribbon cartridges 71–74 mounted in stacked relationship in a housing 76. The housing includes a plurality of spaced slots for receiving and holding the cartridges in stacked relationship, one above the other. The cartridges are of the type described in copending application Serial No. 370,201, filed Apr. 21, 1982, entitled CARTRIDGE FOR MATRIX PRINTER, in the names of Richard Trezise, Keith Gnutzman and John Boldt, and include a ribbon and suitable capstan drive for driving the ribbon. The cartridges include a capstan drive gear 77 which extends outwardly from the side of the cartridge housing and is adapted to be engaged by driving means associated with the carriage, to be presently described but which are shown there also. The present invention provides means whereby the cartridges can be selectively brought into relationship with the print head 62 to permit the printing of selected colors.

Referring to FIG. 5, the print head is shown associated with the top cartridge 71. The cartridge housing 76 is in its lowered position and rotated counterclockwise to bring the cartridge 71 into cooperation with the print head end 63.

FIG. 6 shows the cartridge housing rotated clockwise whereby the second cartridge 72 is brought into cooperative relationship with the print head end 63.

The cartridges 73 and 74 may likewise be brought into cooperative relationship with the print head by lifting the cartridge housing to the position shown in dotted outline and tilting or rotating the housing counterclockwise and clockwise respectively. It will, of course, be understood that the individual cartridges may be brought into cooperative relationship with the print head by positioning the cartridge housing in multiple vertical positions without tilting, or alternatively solely by tilting. It would also be possible to pivot a stack or cartridge in such a manner as to selectively bring a desired color or ribbon position into cooperative relationship with the head. However, the embodiment to be described tilts the housing as described in connection with FIGS. 5 and 6.

The cartridge housing 76 includes spaced guide pins 81 and 82, FIG. 4, on opposite sidewalls thereof. The pins ride in the vertical slots 83 formed in the sidewalls of the carriage main frame 61. In FIG. 4, the cartridge housing is shown in three positions: position 86 which corresponds to operation of the print head in association with the first and second cartridges 71 and 72; position 87 for operation in connection with the lower two cartridges 73 and 74; and position 88 wherein the housing is withdrawn from the main frame to permit insertion and removal of cartridges as desired.

For loading, the housing is lifted upwardly whereby the pins 81 and 82 travel upwardly along the slot with the pin 81 lifted out of the open ended slot while the pin 82 is at the top of the slot. The levers 91, 92 and 93 are rotated accordingly and a latch is engaged to hold the housing in its extended position. In normal operation, however, the cartridge is in either position 86 or 87. In normal operation, the housing 76 may be tilted in a counterclockwise direction, around pin 81 as an axis, so that pin 82 engages the right hand side of slot 83 or it may be tilted in the clockwise direction so that the pin 82 rides into slot 97. The foregoing two positions are illustrated in FIGS. 5 and 6.

To rapidly move the cartridge housing 76 in a controlled plane so that any of the four cartridges may be selectively placed in a printing position, in addition to vertical slots 83 which are formed in the sidewalls of the main frame 61 of the carriage, a four-bar linkage is used to provide this vertical movement. This has the advantage of reducing side loads on vertical slots 83. These include: the U-shaped lever 92 which extends on both sides of the housing as better illustrated in FIG. 3 and which is pivoted to the frame 61 at point 92*a;* lever 91 attached to pin 81 and attached at its midpoint pivot point 92*b* to lever 92 and at its far end to lever 93 at point 93*b;* lever 93 is pivoted at 93*a* to the carriage frame; and a lever 99 which is actuated by electromagnet 98, as best shown in FIG. 3 and is pivoted at point 99*a.* This lever acts on the pin 82. U-shaped lever 92 helps to equalize the force of lever 99.

In summary, the four-bar linkage may be classically analyzed as follows: Between points 92*a* and 93*a,* is the fixed link; levers 92 and 93 are cranks; and lever 91 serves as a coupler link.

A spring 104 contacts pin 81 and is connected to point 92*b,* and a spring 103 is connected to pin 82 and a point 103*a* on lever 92. These springs maintain the housing 76 in the position shown in FIG. 4 while electromagnet 98 is de-energized. Of course, spring 104 may be wrapped around pin 81 to keep it in position.

To tilt the cartridge housing 76 from the position as shown in FIG. 4 and FIG. 5 in a clockwise direction to that shown in FIG. 6 (and the tilting effectively occurs about pin 81 as a pivot point), the housing tilt electromagnet 96 is energized. This pulls the bottom of the housing forward allowing pin 82 to ride into slot 97. Cartridge 72 is moved into cooperative relationship with the print head end 63. With the electromagnet de-energized, the cartridge housing tilts counterclockwise and cartridge 71 is now in cooperative relationship with print head 63.

To bring either of the cartridges 73 and 74 opposite the print head end 63, electromagnet 98 is actuated to cause the rotation of lever 99 which engages pin 82 and slides the pins 81 and 82 upwardly along the slot 83 to a position where pin 81 is opposite the notch 101 as seen in FIG. 5. This is shown in a dashed form. Of course, pin 82 now occupies the position of pin 81. Here the print head is initially in association with cartridge 73. To bring cartridge 74 into position, the housing tilt electromagnet 96 is energized tilting the bottom of the housing forward and bringing the cartridge 74 into a cooperative relationship with the print head. Here the pin 81 rides into the slot 101.

The word "electromagnet" as used here may include solenoids or some other electrically activated device such as a stepper motor.

To provide for easy passage of the edge of the ribbon during a cartridge change, an accurate guide 75 is provided on head end 63 which includes, of course, an aperture for the printing pins. However, in their retracted state, the guide shields the ribbon edge from the pins by extending slightly beyond them; e.g., 2 mils.

Thus, in summary, by the selective energization of the electromagnets 96 and 98, a selected one of the four cartridges can be brought into cooperate relationship with the print head end 63. At the same time a cartridge is being selected, the capstan drive gear 77 (FIG. 3) of the cartridge must be engaged with suitable drive means which are mounted on the carriage. Referring briefly to FIG. 3, the cartridge, as discussed in the copending application, includes a splined hub 77*a* which may be engaged on either side by drive means from the printer itself which are mounted on the carriage. Gear 77, as discussed in the copending "cartridge" application, by its periphery, drives a capstan which provides a nip that draws the ribbon through the cartridge. And, as still discussed in that copending application, the outboard location of gear 77 and the fact that it is narrower or thinner than the remaining part of the cartridge (see FIGS. 5 and 6) allows suitable drive means from the carriage to be laterally moved into place to engage the splined hub 77*a.*

Referring briefly to FIGS. 3 and 4 to describe the drive means, a stepping motor 111 drives a gear 112 which in turn drives an idler gear 110 which in turn drives a gear 113 supported on a lever 114. Gear 113 has as its rotational axis a two-sided spline gear 121 which mates with the splined hub 77*a* of a cartridge from either the top or the bottom sides. Details of this drive system are shown in the above copending application entitled CARTRIDGE FOR MATRIX PRINTER. Lever 114 is pivoted about a pin 116 which is fixed to the carriage so that the drive means may be laterally moved between a pair of cartridges so that each end of the splined gear 121 is juxtaposed with a capstan drive gear 77 and specifically the splined hub 77*a.* This is shown in FIGS. 5 and 6 where in FIG. 5 the upper part spline gear 121 is engaging the gear 77 of the cartridge 71; and in FIG. 6, the lower portion is engaging the gear 77 of cartridge 72.

The remainder of the driving arrangement includes the spring 117 wrapped around pin 116 to move lever 114 clockwise (as illustrated in FIG. 3 out of engagement or away from the cartridges); and in addition, an electromagnet 118 which is best shown in FIG. 3 rotates a lever 119 which laterally moves the drive means between the gap in a cartridge pair. The last portion of the cartridge drive means is the drive tilt electromagnet 122 which pivots the complete drive assembly about the pin 123 to bring the upper portion of the spline gear 121 into engagement with the capstan drive gear 77 of either cartridges 71 or 73 for positions 86 or 87 respectively. One of these positions is shown in FIG. 5. In FIG. 6, with cartridge 72 engaged, the drive tilt electromagnet 122 has been de-energized.

Thus, the following sequence of operations would occur in bringing a ribbon cartridge such as 71 into cooperative relationship with a print head and engaging it with the cartridge ribbon drive means. First, by the use of electromagnet 98, the cartridge housing is moved to the position where the appropriate cartridge pairs are associated with the platen and print head. Assuming a cartridge 71 is the intended one, this is accomplished as illustrated by the position of FIG. 5. With the drive tilt electromagnet 122 de-energized, the cartridge ribbon drive means is laterally moved, by electromagnet 118, between the cartridges 71 and 72. Then the drive tilt electromagnet 122 is powered causing engagement of the spline gear 121 with gear 77. Printing can now commence.

If cartridge 72 is now desired to be used, the drive tilt electromagnet 122 is de-energized to fall to the position shown in FIG. 6 and then the cartridge housing tilt electromagnet is energized to move the cartridge 72 into cooperative relationship with the print head and concurrently engages spline gear 121. And the same procedure follows for the cartridges 73 and 74. Thereafter, the stepping motor 111 is energized through suitable circuits to incrementally move the ribbon pass the head as printing progresses and to stop movement during idle positions. However, to promote engagement of the spline gear, motor 111 is temporarily energized (e.g., a fraction of a revolution) to cause the gear to be cammed into position by the sloped surfaces on gear 77 as more fully illustrated in the copending "cartridge" application.

In summary, it is apparent that the foregoing ribbon drive technique is especially useful with color printing because of the selective nature of the ribbon drive. Only that ribbon which is actually being used is incremented. However, depending on application, if it is wished to simplify the cartridge ribbon drive, a continuous drive of all ribbon cartridges could be accomplished by the use of a single spline extending through all of the cartridges. This is easy to accomplish since they are already vertically stacked.

Another alternative is that a wide mono-color cartridge could be used having several tracks, and each track selectively placed into cooperative relationship with the head by the foregoing techniques. Thus, a maximum width of ribbon could be utilized to extend impression life creating in essence an extremely long life cartridge. Here, of course, the ribbon drive would be greatly simplified and only a shifting of the ribbon itself would be necessary.

And, with reference to the shifting and tilting described, although this is believed to be very effective to rapidly move from one ribbon to another especially where a multi-color effect is wanted, the movement of the cartridge housing could be accomplished entirely in a vertical movement rather than the use of the tilt. Thus, the pair of cartridges would be moved to span the end of the print head 63, the cartridge print drive would be laterally moved in, and then another vertical up or down motion would be accomplished to engage the print drive and move the selected cartridge into position.

Thus, it is seen that there has been provided a novel color printer, more particularly a color printer which is adapted to receive a plurality of cartridges which can be selected for any given color including the primary and blendable colors. In normal operation, the top cartridge would preferably contain black ribbon since it is the one normally used. This position is most readily available to an operator in normal usage of the printer. However, the printer will accommodate any user defined order and mix of ribbon cartridges. A single print head is employed to print from the ribbon which is selectively associated with the print head in response to electrical commands. The assembly is simple in construction and yet provides an improved printing system.

It is, of course, to be understood that although a high speed impact matrix print head has been described that the present invention is adaptable to printing systems which use rotary wheel printing. Furthermore, systems employing cartridges of other designs and configurations can be designed and still be within the scope of the present invention.

What is claimed:

1. A printer including a platen, a carriage for moving a printing head along a line of printing to print from a print ribbon disposed between the print head and platen, said carriage including:

cartridge housing means for replaceably supporting a plurality of print ribbon cartridges one above the other;

means carried by said carriage for providing vertical movement of said cartridge housing means to bring the ribbon of a selected cartridge between the print head and the platen at any printing location in said line of printing, said means for providing vertical movement of said cartridge housing means including a pair of vertical slots in a pair of sidewalls fixed to said carriage said housing means having corresponding pins which ride in such slots; and ribbon drive means for moving ribbon past the print head as printing progresses.

2. A printer as in claim 1 including ribbon guide means offset from the end of said print head for allowing easy passage of said ribbons past said head during said vertical movements.

3. A printer including a platen, a carriage for moving a printing head along a line of printing to print from a print ribbon disposed between the print head and platen, said carriage including:

cartridge housing means for replaceably supporting a plurality of print ribbon cartridges one above the other;

means carried by said carriage for providing vertical movement of said cartridge housing means to bring the ribbon of a selected cartridge between the print head and the platen at any printing location in said line of printing; ribbon drive means for moving ribbon past the print head as printing progresses;

said means for moving said housing means including means for moving the housing means vertically to place a pair of cartridges into association with said print head and including means for tilting said housing means clockwise or counterclockwise to bring the ribbon in the upper or lower cartridge of the pair between the print head and the platen.

4. A printer as in claim 3 in which said ribbon drive means includes first electromagnet means for laterally moving said drive means opposite a selected cartridge and second electromagnet means for moving the drive means into cooperative engagement with the selected cartridge.

5. A printer as in claim 4 where said drive means is laterally movable into a gap between said cartridges and said second electromagent means tilts such drive means to engage a cartridge.

6. A printer including a platen, a carriage for moving a printing head along a line of printing to print from a print ribbon disposed between the print head and platen, said carriage including:

cartridge housing means for replaceably supporting a plurality of print ribbon cartridges one above the other;

means carried by said carriage for providing vertical movement of said cartridge housing means to bring the ribbon of a selected cartridge between the print head and the platen at any printing location in said line of printing;

ribbon drive means for moving ribbon past the print head as printing progresses;

means for providing a wider print gap between said print head and said platen during said vertical movement and at any printing location in said line of printing including electromagnet means for tilting said carriage away from said platen and including a pair of axes on which said carriage is slidably mounted for movement along said line of printing said electromagnet means adjusting the distance between said carriage and one of said axes to provide said tilt.

* * * * *